US009756929B2

(12) United States Patent
Moreau et al.

(10) Patent No.: US 9,756,929 B2
(45) Date of Patent: Sep. 12, 2017

(54) HAND-TOOL RETRACTOR COVER HAVING INCREASED DROPPED TOOL HOLDING STRENGTH

(71) Applicant: TY-FLOT, INC., Manchester, NH (US)

(72) Inventors: Darrell A. Moreau, Manchester, NH (US); Andre W. Moreau, Bedford, NH (US); Reginald Moreau, Litchfield, NH (US)

( * ) Notice: Subject to any disclaimer, the term of this patent is extended or adjusted under 35 U.S.C. 154(b) by 0 days.

(21) Appl. No.: 15/044,800

(22) Filed: Feb. 16, 2016

(65) Prior Publication Data

US 2017/0231375 A1 Aug. 17, 2017

(51) Int. Cl.
*A45F 5/00* (2006.01)
*A45F 5/02* (2006.01)
*B65H 75/40* (2006.01)

(52) U.S. Cl.
CPC ..... *A45F 5/004* (2013.01); *A45F 5/021* (2013.01); *A45F 5/022* (2013.01); *B65H 75/40* (2013.01)

(58) Field of Classification Search
CPC ..... A45F 5/004; A45F 5/021; A45F 5/022; B65H 75/40
USPC ..... 224/162, 254
See application file for complete search history.

(56) References Cited

U.S. PATENT DOCUMENTS

2006/0054729 A1 3/2006 Salentine et al.
2006/0163412 A1 7/2006 Szarkowski et al.
2008/0042000 A1 2/2008 Horton
2012/0153064 A1 6/2012 Votel et al.

FOREIGN PATENT DOCUMENTS

KR 20-0462452 Y1 9/2012

OTHER PUBLICATIONS

Korean Intellectual Property Office, PCT Search Report and Written Opinion, PCT Application No. US2016/022025 (Nov. 7, 2016).

*Primary Examiner* — Peter Helvey

(57) ABSTRACT

A hand-tool retractor cover includes a body portion and a handle portion attached to and extending from the body portion. The body portion has a first-side wall, a second-side wall spaced apart from and substantially parallel to the first-side wall, and a perimeter wall extending transversely between and connecting the first-side wall to the second-side wall. The body portion defines a retractor compartment between the first-side wall, the second-side wall, and the perimeter wall. The body portion also defines an entrance into the retractor compartment and a retractor cable opening. The handle portion defines a handle opening and is made of a stretchable and resilient material. The stretchable and resilient material is adapted to increase a weight rating of a hand tool retractor when a hand tool retractor is placed within the hand tool retractor cover.

22 Claims, 7 Drawing Sheets

HAND-TOOL RETRACTOR COVER HAVING INCREASED DROPPED TOOL HOLDING STRENGTH

BACKGROUND OF THE INVENTION

1. Field of the Invention

The present invention relates generally to tool accessories and more particularly to a cover for retractors.

2. Description of the Prior Art

Carpenters, designers, facilities maintenance personnel, and other workers regularly use hand tools on a job site. Job site safety rules often require workers to tether a hand tool to the worker or structure to prevent inadvertent drops into critical areas. For example, a wrench dropped into cooling water at a nuclear facility may require shut down of the system so that the wrench can be retrieved. For this reason, the facility may require that all hand tools be tethered to the worker.

For convenience, some workers use a retractable tether to secure hand tools to their person. A free end of a retractor is attached to the hand tool and the retractor is attached to the worker by a belt clip or being housed within a retractor pocket. One example of such a retractable tether is a retractable key ring, where the retractor body clips onto the user's belt or waist band. Keys (or other light-weight object) are secured to the free end of the retractor cable. Another example is a retractor retained within a leather pocket on a tool pouch, where the pouch is part of a tool belt. A free end of the retractor cable extends through an opening in the tool pouch and is secured to a hand tool. In the tool pouch configuration, the retractor is often housed in a pocket adjacent to a tool slot or tool pocket.

SUMMARY OF THE INVENTION

A limitation of retractable tethers is its usefulness for tools only below a given weight. For example, some retractable reels for keys and small tools have a maximum capacity of 8 to 10 ounces (225-280 grams). While this may be sufficient for keys, the load may be easily exceeded with a small hand tool. If the tool is dropped, the retractor mechanism can be damaged by the force exerted on the retractor when the tool reaches the bottom of its fall.

As the capacity of retractors increases, so does the size, weight, and price of the retractor. For example, a retractor with a weight rating of 5 pounds typically has a steel cable, steel housing, and an overall size and weight that is undesirable for a worker to carry on his person throughout the work day. Retractors of lighter weight may have a maximum load rating of 1.5 to 2 pounds (0.7-0.9 Kg.) A dropped tool can easily exceed this load rating.

Therefore a need exists for improved weight rating in hand tool retractors without the disadvantages of excessive size and weight.

The present invention achieves these and other objectives by providing a retractor cover having a cover body or body portion that defines a retractor compartment where the cover body or body portion is made of a stretchable and resilient material, and retractor cable opening, where the retractor cover can be attached to a worker or structure and is constructed to house a retractor in the retractor compartment. Having the cover body or body portion made of a stretchable and resilient material provides an increased holding weight to a hand tool retractor. For example, one embodiment of the retractor cover of the present invention increases a hand tool retractor having a weight rating of 1 pound (453.6 grams) to one having at least 2 pounds (907 grams).

In one embodiment, a hand-tool retractor cover has a body portion and a handle portion. The body portion has a first-side wall, a second-side wall spaced apart from and substantially parallel to the first-side wall, and a perimeter wall extending transversely between and connecting the first-side wall to the second-side wall. The body portion has a wall thickness and defines a retractor compartment substantially enclosed by the first-side wall, the second-side wall, and the perimeter wall. The body portion defines an entrance into the retractor compartment and a retractor cable opening. The handle portion is attached to and extending from the body portion and defines a handle opening. The handle portion has a handle thickness that is greater than the wall thickness, thereby rendering the body portion more stretchable than the handle portion. At least one of the body portion and the handle portion is made of a stretchable and resilient material adapted to increase a weight rating of a hand tool retractor when a hand tool retractor is placed within the hand tool retractor cover.

In another embodiment, the entrance comprises a slot along a top side of the perimeter wall. The handle portion includes a first handle portion extending from a top side of the body portion and adjacent the slot, where the first handle portion defines a first handle opening. The handle portion also includes a second handle portion extending from the top side of the body portion and adjacent the slot, where the second handle portion defines a second handle opening. The first handle opening and the second handle opening are aligned with each other and comprise the handle opening. The first handle portion and the second handle portion are separable such as by pulling away from the entrance in opposite directions to permit access to the retractor compartment via the entrance.

In another embodiment, a hand-tool retractor cover includes a body portion having a first-side wall, a second-side wall spaced apart from and substantially parallel to the first-side wall, and a perimeter wall extending transversely between and connecting the first-side wall to the second-side wall. The body portion has a wall thickness and defines a retractor compartment between the first-side wall, the second-side wall, and the perimeter wall. The body portion defines an entrance into the retractor compartment and a retractor cable opening opposite the entrance. A handle portion has a first handle portion and a second handle portion. The first handle portion has a first handle thickness and extends from the body portion adjacent the first-side wall. The first handle portion defines a first handle opening therethrough. The second handle portion has a second handle thickness and extends from the body portion adjacent the second-side wall. The second handle portion defines a second handle opening therethrough. The first handle portion and the second handle portion extend from the body portion from opposite sides of the entrance in substantially parallel relation with the first handle opening aligned with the second handle opening. The retractor cover is made of an elastomer adapted to increase a weight rating of a hand tool retractor when a hand tool retractor is placed within the hand tool retractor cover. The first handle thickness and the second handle thickness are each greater than the wall thickness, thereby rendering the body portion more stretchable than the handle portion.

In some embodiments, the stretchable and resilient material is a silicone rubber with a durometer from about 30 to about 70 on a Shore-A hardness scale.

In some embodiments, the body portion is made of the stretchable and resilient material. In another embodiment, the body portion and the handle portion are a monolithic structure made of the stretchable and resilient material.

In some embodiments, the hand-tool retractor cover includes a tool-holding clip attached to the body portion.

In some embodiments, the hand-tool retractor cover includes a magnetic member retained by the body portion.

In some embodiments, the hand-tool retractor cover includes closed-loop connector extending through the handle opening, such as a strap made of a stretchable material and defining a closed loop, a carabiner, a screw link, or a shackle.

In some embodiments, the hand-tool retractor cover includes a retractor disposed in the retractor compartment, where the retractor has a retractor body and a retractor cable. The retractor body is snugly received in the retractor compartment with the retractor cable extending through the retractor cable opening.

In some embodiments, the hand-tool retractor cover includes a permanent magnet retained by the body portion. For example, the permanent magnet has a size sufficient to retain a ferrous hand tool. In some embodiments, the permanent magnet is seized to retain a ferrous hand tool with a hand tool weight of at least eight ounces.

In some embodiments, the first handle thickness and second handle thickness are each at least 3 times as great as the wall thickness of the body portion. In one embodiment, the wall thickness is about 0.08 inch.

In some embodiments, the hand-tool retractor cover and the retractor are provided as a combination, where the retractor may be installed into the retractor compartment of the retractor cover.

Another aspect of the present invention is directed to the combination a retractor and a hand-tool retractor cover. In one embodiment of the combination, the hand-tool retractor cover includes a body portion having a first-side wall, a second-side wall spaced apart from and substantially parallel to the first-side wall, and a perimeter wall extending transversely between and connecting the first-side wall to the second-side wall. The body portion defines a retractor compartment between the first-side wall, the second-side wall, and the perimeter wall. The body portion defines an entrance into the retractor compartment and a retractor cable opening. A handle portion is attached to and extends from the body portion and defines a handle opening. The retractor cover is made at least in part of a stretchable and resilient material. The hand-tool retractor includes a retractor body and a retractor cable selectively deployable from the retractor body. The stretchable and resilient material is adapted to increase a weight rating of the hand tool retractor when the hand tool retractor is placed within the hand tool retractor cover with the retractor cable deployable through the retractor cable opening.

In one embodiment, the hand-tool retractor cover increases the weight rating by at least 40% a maximum weight without failure of the hand-tool retractor when the hand-tool retractor is disposed in the retractor compartment In another embodiment, the stretchable and resilient material is a silicone rubber with a durometer from about 30 to about 70 on a Shore-A hardness scale.

In another embodiment, the hand-tool retractor includes a closed-loop connector extending through the handle opening, such as a strap made of a stretchable material and defining a closed loop, a carabiner, a screw link, or a shackle.

In another embodiment, a split key ring is connected to a free end of the retractor cable, where the split key ring has a weight rating no greater than the weight rating of the retractor when installed in the retractor cover and where the split key ring is adapted for connection to a lanyard or tether.

Another aspect of the present invention is directed to a method of increasing the weight rating of a hand tool retractor. In one embodiment, the method includes providing a retractor cover made at least in part of a stretchable and resilient material, where the retractor defines a compartment and a retractor cable opening in communication with the compartment, providing a hand tool retractor with a retractor cable, and disposing the hand tool retractor in the compartment of the retractor cover with the retractor cable extending through the retractor cable opening, where the retractor cover absorbs some of the forces of a dropped hand tool connected to the retractor cable.

In another embodiment, the method includes providing a retractor having a retractor body and a retractor cable selectively deployable from the retractor body; providing a retractor cover that includes a body portion and a handle portion attached to and extending from the body portion. The body portion has a first-side wall, a second-side wall spaced apart from and substantially parallel to the first-side wall, and a perimeter wall extending transversely between and connecting the first-side wall to the second-side wall to define a retractor compartment. The body portion defines an entrance into the retractor compartment and also defines a retractor cable opening. The handle portion is made of a flexible and resilient material and defines a handle opening. The method also includes installing the retractor body into the retractor compartment with the retractor cable selectively deployable through the retractor cable opening; connecting the retractor cover to a worker or structure via the handle portion; and connecting a free end of the retractor cable to a hand tool to be tethered. In some embodiments, the retractor compartment is sized and shaped to snugly receive the retractor body.

In another embodiment, the step of providing the retractor cover includes selecting the retractor cover to include a strap defining a closed loop that extends through the handle opening, where the strap made of a stretchable material.

In another embodiment, the step of providing the retractor cover includes selecting the retractor cover made as a monolithic structure of silicone rubber with a durometer from about 30 to about 70 on a Shore-A hardness scale. In one embodiment, the retractor cover is selected with a Shore-A durometer of about 40.

In another embodiment, the step of providing the retractor cover includes selecting the retractor cover with the entrance defined as an opening or slot along a top side of the body portion and with the handle portion comprising a first handle portion and a second handle portion each connected to and extending from a top side of the body portion adjacent the entrance.

In another embodiment, the step of providing the retractor cover includes selecting the retractor cover to include a magnetic member retained by the body portion.

In another embodiment, the step of providing the retractor cover includes selecting the retractor cover to include a tool-holding clip secured to the body portion and extending along an outside surface of the first-side wall.

In another embodiment, the method also includes the steps of (i) selecting a split key ring with a weight rating no greater than the weight rating of the retractor when installed in the retractor cover and (ii) connecting the split key ring between the free end of the retractor cable and the tool to be tethered. Deformation of the split key ring indicates the retractor has been subjected to forces of a dropped tool.

DETAILED DESCRIPTION

Figure 1:
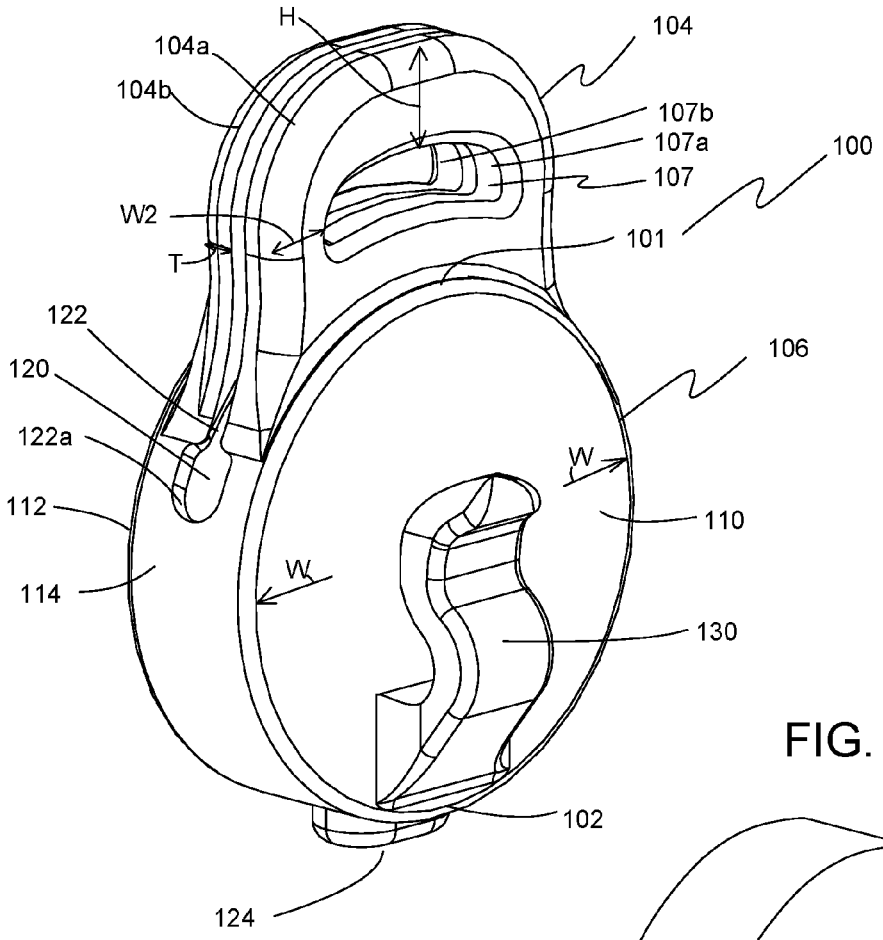
FIG. 1 is a perspective view of one embodiment of a retractor cover of the present invention.
Figure 2:
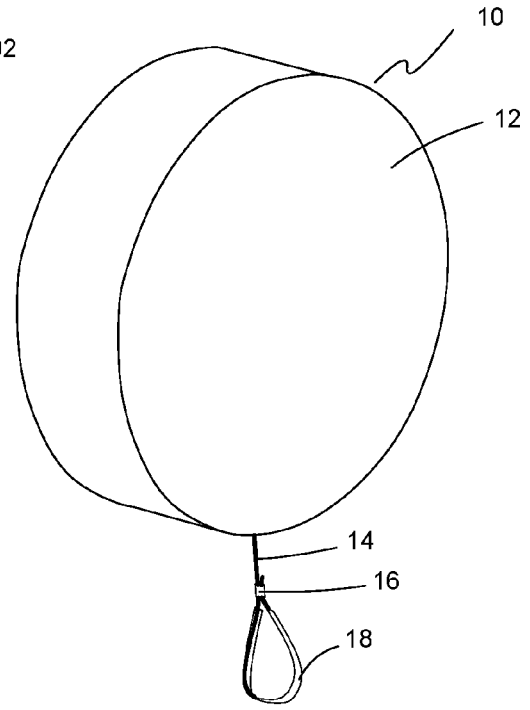
FIG. 2 is a perspective view of one embodiment of a retractor with retractor body and retractor cable.

The preferred embodiments of the present invention are illustrated in FIGS. 1-14. Referring to FIG. 1, a front, perspective view illustrates one embodiment of a retractor cover 100 of the present invention with a handle portion 104 and a body portion 106. For reference, FIG. 2 illustrates a perspective view of one embodiment of a retractor 10 with a retractor body, a retractor cable 14, and a crimp 16 securing retractor cable 14 to connector 18. As discussed in more detail below, body portion 106 of retractor cover 100 is constructed of a stretchable and resilient material to removably house retractor body 12 and permit operation of retractor cable 14 while increasing the weight rating of retractor 10. As understood by those skilled in the art, weight rating means the maximum amount of weight of a hand tool that can be safely attached to the hand tool retractor. In other words, the retractor's load capacity.

Body portion 106 of retractor cover 100 has a first-side wall 110 and a second-side wall 112 spaced apart from and substantially parallel to first-side wall 110. A perimeter wall 114 (also referred to as a perimeter sidewall 114 in some embodiments) extends transversely between and connects first-side wall 110 to second-side wall. First-side wall 110, second-side wall 112, and perimeter wall 114 define and generally enclose an open retractor compartment 120 (shown more clearly in FIG. 8.) Body portion 106 defines an entrance 122 to retractor compartment 120 and a retractor cable opening 124 for passage of a retractor cable 12 (shown in FIG. 2). In some embodiments, body portion 106 is made of a resilient material such as silicone rubber or the like. For example, rubber with a durometer of 30 to 70 on a Shore-A hardness scale is a flexible and relatively soft material that facilitates installation of retractor 10 in retractor compartment 120. Also, the elastic properties of such a material enable retractor cover 100 to stretch and/or bend to absorb forces of a dropped tool connected to a retractor 10 disposed in retractor compartment 120.

In other embodiments, handle portion 104 is made of a hard plastic, metal, carbon fiber, fiberglass or other rigid or semi-rigid material lacking the elasticity of silicone rubber. In such an embodiment, the elastomeric material of body portion 106 stretches to absorb forces of a dropped tool connected to a retractor 10 disposed in retractor compartment 120 while handle portion 104 provides structural integrity to maintain retractor cover 100 connected to a worker or to equipment.

In one embodiment, entrance 122 is an opening along a top side 101 of body portion 106, such as a slit along perimeter wall 114. Optionally as shown in FIG. 1, a first entrance end 122*a* and a second entrance end 122*b* of entrance 122 are enlarged to facilitate bending of body portion 106 to open entrance 122. Entrance 122 may have other locations on body portion 106 and different configurations, particularly when body portion 106 is made of more rigid materials (i.e. Shore-A hardness greater than 70). For example, entrance 122 may be a hinged door or flap (not shown) in second-side wall 112.

Retractor cable opening 124 is typically positioned along a bottom side 102 of retractor cover 100, but may be in other locations depending on the retractor geometry and the intended use of retractor cover 100. In one embodiment, retractor cable opening 124 is a round or oval opening through bottom side 102 of body portion 106 and is sized to permit passage of retractor cable 14. Optionally, retractor cable opening 124 is sized to also accommodate crimp 16 or other fastener on retractor cable 14.

Handle portion 104 is connected to and extends from body portion 106 of retractor cover 100. In one embodiment, handle portion 104 includes a first handle portion 104*a* and a second handle portion 104*b* extending from a top side 101 of perimeter wall 114 adjacent entrance 122. For example, first handle portion 104*a* is located on one side of entrance 122 towards first-side wall 110 and second handle portion 104*b* is on the opposite side of entrance 122 towards second-side wall 112, where first and second handle portions 104*a*, 104*b* are slightly spaced apart and extend together in alignment from body portion 106. First and second handle portions 104*a*, 104*b* may be pulled away from each other transverse to entrance 122 in opposite directions to make accessible and open entrance 122 for installation of retractor 10 in retractor compartment 120.

In one embodiment, first handle portion 104*a* extends further from body portion 106 than second handle portion 104*b* so that first handle portion 104*a* may pass through second handle opening 107*b* with sufficient length after doing so for attachment to the user by connecting a closed-loop connector 180 (shown in FIG. 13) through first handle opening 107*a*. That is, after passing through second handle opening 107*b*, first handle opening 107*a* is positioned vertically above top 104*c* of second handle portion 104*b*.

Handle portion 104 defines a handle opening 107. For example, first handle portion 104*a* defines first handle opening 107*a* and second handle portion defines second handle opening 107*b* that are aligned with one another. In one embodiment, handle portion 104 has an arch shape or convexly curved shape. An advantage of such as shape is that when subjected to a tensile stress, the arch shape resists catching on clothing and tends to distribute the stress more evenly across handle portion 104. As believed to more evenly distribute drop forces to body portion 106, handle portion in some embodiments is attached along most or all of a width W of top side 101 of body portion 106.

In one embodiment, retractor cover 100 is made of silicone rubber with a Shore-A durometer of 42, where each of handles 104*a*, 104*b* has a thickness T of about 0.2 inch (5.0 mm), a width W2 of about 0.3 inch (7.7 mm) measured horizontally from handle opening 107, and a height H of about 0.4 inch (10.5 mm) measured vertically from handle opening 107. Body portion 106 has a wall thickness of about 0.8 inch (2 mm).

Handle portion 104 (or entire retractor cover 100) is made of a stretchable and resilient material, such as a rubber or elastomer with a durometer of 30-70 on a Shore-A hardness scale. In some embodiments, handle portion 104 is monolithic with body portion 106, where retractor cover 100 is made as a single unit with a flexible and resilient material such as silicone rubber. As such, retractor cover 100 permits easy installation of retractor 10 into retractor compartment 120. Also, such a material absorbs forces of a dropped hand tool connected to retractor 10 since all or part of retractor cover 100 stretches when subjected to the force of a dropped tool. Particularly, handle portion 104 stretches and resumes its shape to absorb the forces of a dropped tool or other object. Further, when body portion 106 of retractor cover 100 is made of a soft rubber, it prevents scratching and reduces impact forces when knocked against other items, such as metal scaffolding.

The material and its hardness for retractor cover 100 may be selected based on the weight rating of the retractor 10, operating temperature, materials used to build retractor 10, and dimensions of those materials. For example, a retractor 10 rated for a load of 2 lbs. (0.9 Kg) in drop tests with a weight of 4.5 lbs. (2.045 Kg) failed on the second drop due to a broken retractor cable 14 when retractor cover 100 has a Shore-A durometer of 50. By reducing the Shore-A durometer to 30, failure occurred instead on the third drop with 4.5 lbs. (2.045 Kg) when retractor 10 pulled through retractor cable opening 124. For the retractor 10 that broke with 2.0 lb. loads when tested without retractor cover 100, it was found experimentally that a Shore-A durometer of 42 for retractor cover 100 provided a desirable balance between failure of the retractor 10 components and failure of the retractor cover 100 and enabled failure-free drops using weights of 4.5 to 6.0 lbs. (~2.0-2.7 Kg.) Thus, it is sometimes preferable to increase the Shore-A durometer of retractor cover 100 for retractors 10 with a higher load rating or stronger cable assemblies.

In one embodiment, first-side wall 110 includes a resilient tool-holding clip 130. For example, tool-holding clip 130 is attached to first-side wall 110 near bottom side 102 and extends upward towards handle portion 104. Tool-holding clip 130 may also extend in a downward, sideways, or other direction, but typically extends upward to discourage its use as a belt clip for retractor cover 100 since such use may defeat some benefits of retractor cover 100. Tool-holding clip 130 is useful to capture and hold objects, such as a small hand tool or connector 18 on retractor 10. In some embodiments, tool-holding clip 130 is made of rubber or other flexible and resilient material. Depending on its material of construction, tool-holding clip 130 may be adhered or welded to body portion 106, formed monolithically with body portion 106, or otherwise attached to body portion 106.

Figure 3:
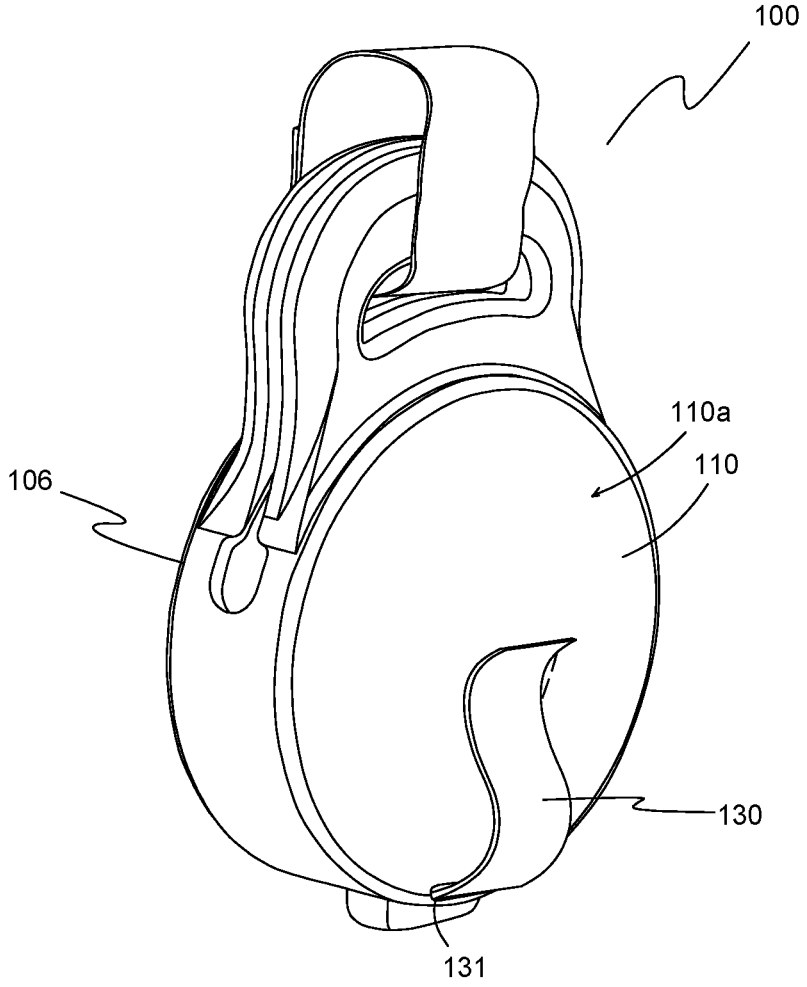
FIG. 3 is a perspective view of another embodiment of a retractor cover of the present invention showing one embodiment of a tool-holding clip installed through a clip opening in the body portion of the retractor cover.
Figure 3A:
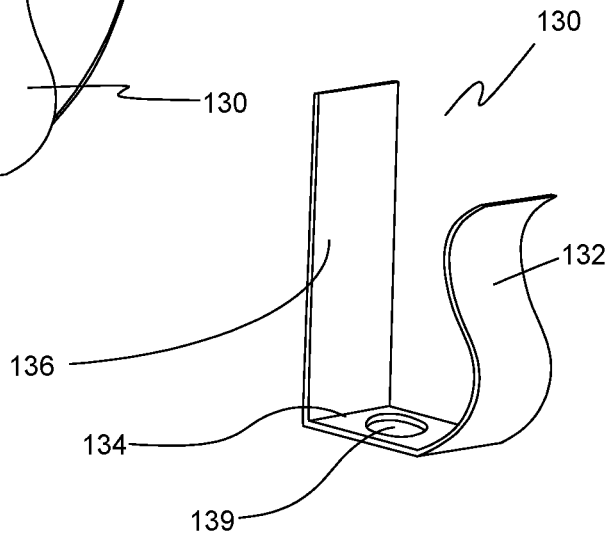
FIG. 3A is a perspective view of the tool-holding clip of FIG. 3.

Referring to FIG. 3, another embodiment of retractor cover 100 is shown in a perspective view with a removable tool-holding clip 130. Tool-holding clip 130 is shown by itself in FIG. 3A for clarity. In this embodiment, tool-holding clip 130 is made of a rigid, but resilient material, such as metal or plastic, and includes a clip body portion 132, a clip base portion 134 extending transversely (e.g., perpendicularly) from clip body portion 132, and a clip support leg 136 extending transversely (e.g., perpendicularly) in a spaced-apart relation with clip body portion 132 to define a U shape. Tool-holding clip 130 extends through a clip opening 131 in first-side wall 110 or perimeter wall 114 of body portion 106 with clip body portion 132 and clip support leg 136 both extending upward. Clip body portion 132 extends along an outside surface 110*a* of first-side wall 110 and clip support leg 136 extends upward along inside surface 120*b* of second-side wall 112. Clip base portion 134 is positioned against an inside surface 114*a* of sidewall 114 and defines an opening 139 as needed to permit passage of retractor cable 14. Tool-holding clip 130 is held in position in part by retractor body 12 occupying the gap between clip support leg 136 and first-side wall 110, the weight of a tethered tool exerting downward pressure on tool-holding clip 130 by way of retractor 10, and due to a snug fit of retractor body 12 in retractor compartment 120 (shown in FIG. 9.)

In other embodiments, retractor 10 includes clip body portion 132 attached to retractor body 12 and extending downward toward retractor cable 14. For such retractors 10, retractor cover 100 has clip opening 131 positioned near top side 101 of body portion 106. During installation, clip body portion 132 passes through clip opening 131 near top side 101 of body portion 106 as retractor 10 is inserted into retractor compartment 120.

Figure 4:
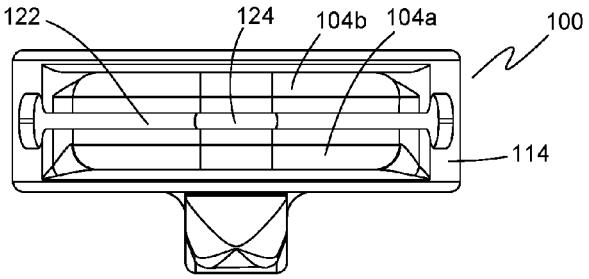
FIG. 4 is a top plan view of the retractor cover of FIG. 1.

FIGS. 4-8 illustrate additional views of the embodiment of retractor cover 100 shown in FIG. 1. FIG. 4 illustrates a top plan view of retractor cover 100, showing entrance 122 between first handle portion 104*a* and second handle portion 104*b*. Retractor cable opening 124 is aligned and centered on entrance 122 and perimeter wall 114.

Figure 5:
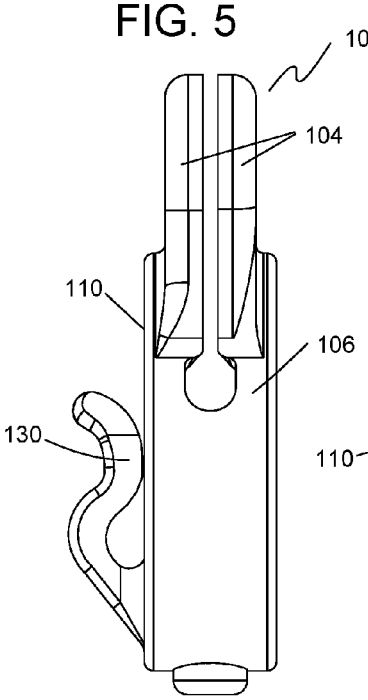
FIG. 5 is a right side elevational view of the retractor cover of FIG. 1.
Figure 6:
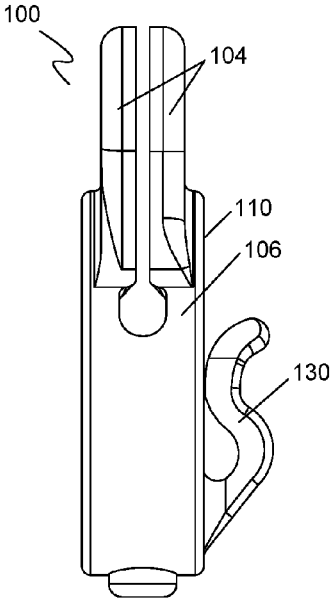
FIG. 6 is a left side elevational view of the retractor cover of FIG. 1.

FIGS. 5 and 6 both illustrate side elevational views of retractor cover 100, showing handle portion 104 extending upward from body portion 106. Optional tool-holding clip 130 is attached to first-side wall 110 and extends upward.

Figure 7:
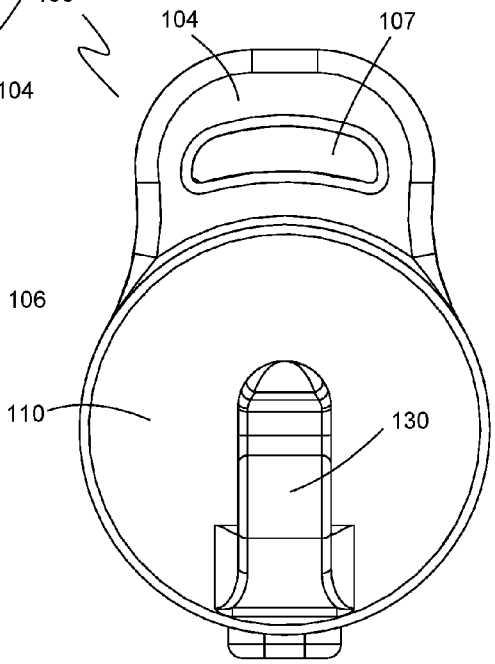
FIG. 7 is a front elevational view of the retractor cover of FIG. 1.

FIG. 7 illustrates a front elevational view of retractor cover 100 showing optional tool-holding clip 130 attached to and extending upward along first-side wall 110. Handle portion 104 and handle opening 107 have an upwardly-convex shape (i.e. downwardly concave shape).

Figure 8:
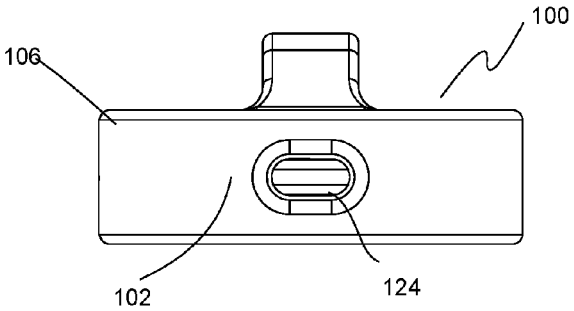
FIG. 8 is a bottom plan view of the retractor cover of FIG. 1 showing the retractor cable opening in the bottom end of the body portion.

FIG. 8 illustrates a bottom plan view of retractor cover 100 showing retractor cable opening 124 on bottom side 102 of body portion 106.

Figure 9:
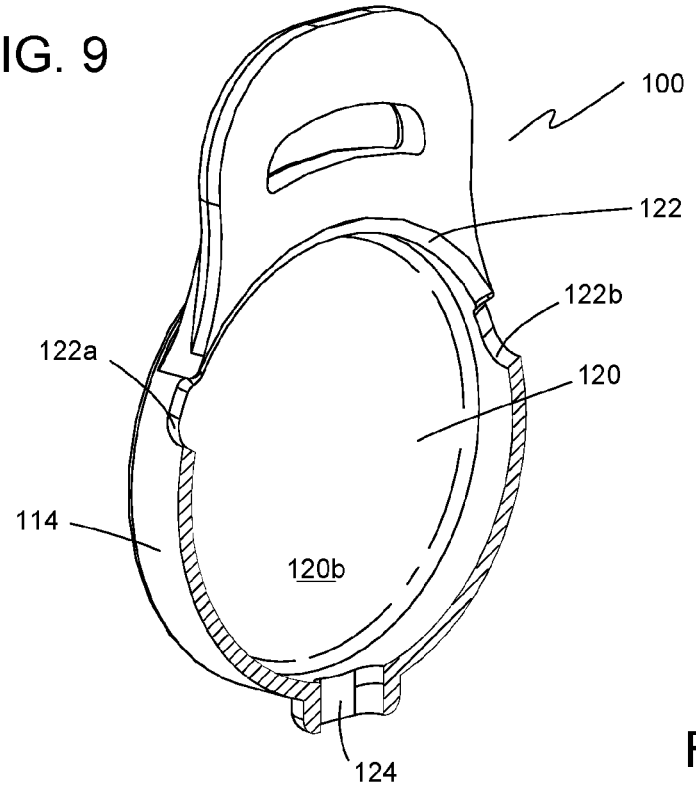
FIG. 9 is a perspective sectional view of the retractor cover of FIG. 1 showing a rear half of the retractor cover.

Referring now to FIG. 9, a section of retractor cover 100 of FIG. 1 is illustrated in a perspective view, where retractor cover 100 is sectioned through perimeter wall 114 along entrance 122. A portion of retractor compartment 120 and retractor cable opening 124 are shown more clearly in FIG. 4 as are ends 122*a*, 122*b* of entrance 122. Although retractor compartment 120 is shown in the figures as having a round shape, other shapes are acceptable. In some embodiments, for example, retractor compartment 120 is square or rectangular. In yet other embodiments, bottom side 102 of retractor cover 100 is straight rather than curved to mate with a retractor having a rectangular shape or flat side where retractor cable 14 exits retractor body 12. One advantage of a rectangular retractor compartment 120 or straight bottom side 102 is that it mates with retractor 10, especially one having a straight edge, to prevent retractor 10 from pulling through retractor cable opening 124.

Figure 10:
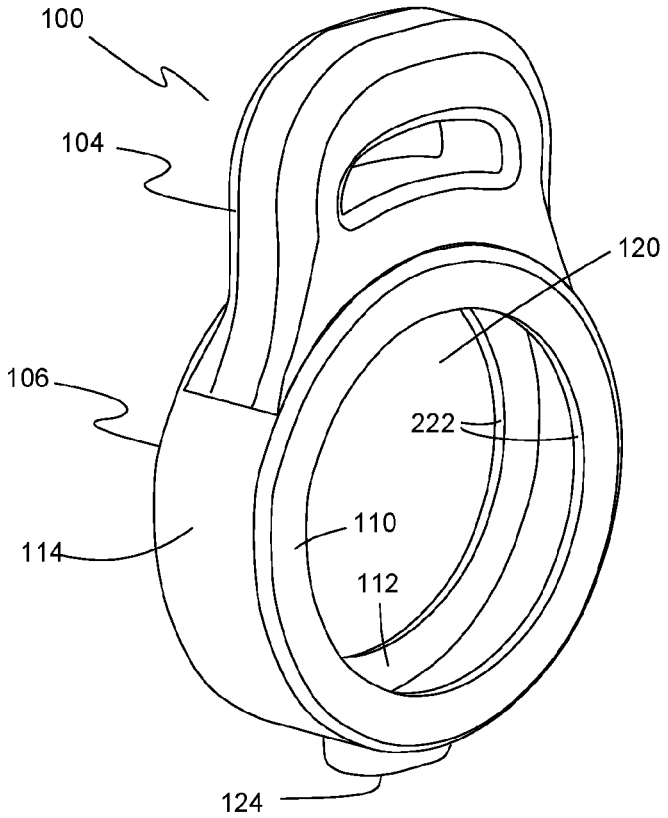
FIG. 10 is a perspective view of another embodiment of a retractor cover of the present invention showing an opening through each of the first-side wall and the second-side wall.

Referring now to FIG. 10, there is illustrated a perspective view of another embodiment of retractor cover 100 with body portion 106 and handle portion 104. In this embodiment, body portion 106 defines an entrance 222 as an opening in first-side wall 110 and/or second-side wall 112 instead of entrance 122 along top side 101 of body portion 106. Retractor compartment 120 is sized and shaped to snugly fit retractor body 12 and retain retractor body 12 between perimeter 114, first-side wall 110, and second-side wall 112 to prevent retractor 10 from decoupling from retractor cover 100. When body portion 106 is made of a flexible and resilient material, it may be stretched over retractor body 12 after inserting retractor cable 14 and connector 18 (if present) through retractor cable opening 124. In contrast to the embodiment illustrated in FIG. 1, handle portion 104 in the embodiment of FIG. 4 is not split into two portions spaced from each other by entrance 122. Instead, handle portion 104 is a single structure attached to or formed monolithically with body portion 106.

Figure 11:
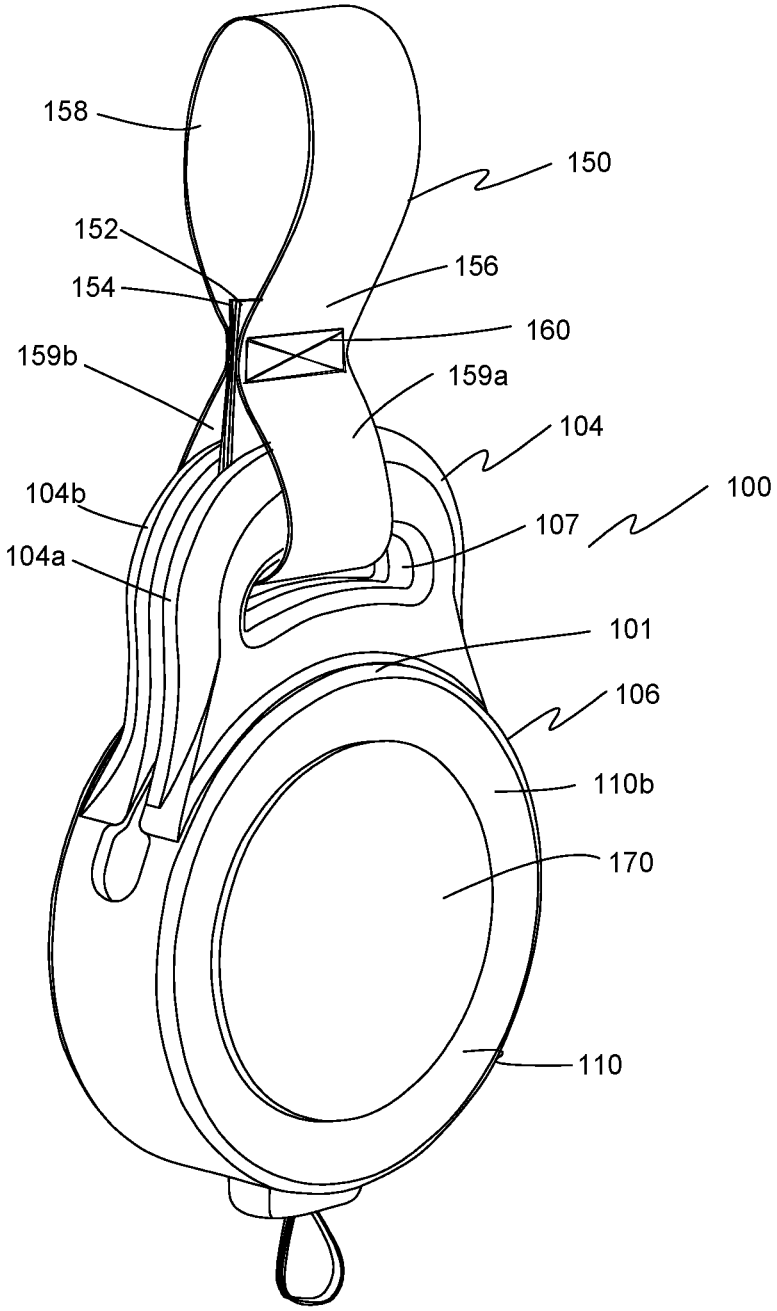
FIG. 11 is a perspective view of another embodiment of a retractor cover of the present invention showing a strap installed through the handle opening and defining a closed loop and also showing an optional disk-shaped magnetic member attached to the outside surface of the first-side wall.

Referring now to FIG. 11, an embodiment of retractor cover 100 has a strap 150 defining a closed loop that extends through an elongated handle opening 107 to secure strap 150 to retractor cover 100. Here, retractor cover 100 has first and second handle portions 104*a*, 104*b* extending upward from opposite sides of entrance 122 along top side 101 of body portion 106. In one embodiment as shown, a first strap end 152 is looped through first handle opening 107*a* and a second strap end 154 is looped through second handle opening 107*b* (shown more clearly in FIG. 1.) First and second strap ends 152, 154 are then brought together between body portion 156 of strap 150 and secured to each other and to body portion 156. Thus, strap 150 defines a principal loop 158 for attachment to a carabiner or other connector, and secondary loops 159*a*, 159*b* that extend through first and second handle openings 107*a*, 107*b*, respectively. Portions of strap 150 may be secured by stitching 160 as illustrated, or by using one or more fasteners (e.g., rivet, grommet, staple, etc.) or other methods known in the art. In other embodiments, strap 150 defines a single closed loop that extends through handle opening 107 with first strap end 152 overlapping and being secured to second strap end 154 or body portion 156 of strap 150.

Strap 150 may be a length of webbing or strip of material, such as woven or non-woven materials and strips of leather, plastic, rubber, elastic, metal, or other material. In some embodiments, strap 150 is made of a stretchable material, such as an elastic strap or fabric containing elastic. In one embodiment, for example, strap 150 is made from a length of woven cotton elastic or woven polyester elastic with a width of about one inch. In other embodiments, strap 150 is substantially non-stretchable and is made of woven nylon webbing, a length of plastic or leather, or the like. An advantage of strap 150 being stretchable is that strap 150 also absorbs forces of a dropped tool connected to retractor 10 disposed in retractor cover 100.

FIG. 11 also illustrates an optional magnetic member 170 that may be installed against an inside surface 110*a* (not visible) or outside surface 110*b* of first-side wall 110. For example, magnetic member 170 is a disk adhered to outside surface 110*b*. In another embodiment, magnetic member 170 is placed in retractor compartment 120 against first-side wall 110 (or second-side wall 112), sharing retractor compartment 120 with retractor body 12. Magnetic member 170 is useful to magnetically attract and hold ferrous tools and other objects when not in use and replaces the tool-holding clip 130 shown in FIG. 1. In some embodiments, magnetic member 170 is embedded in the material of retractor cover 100.

Figure 12:
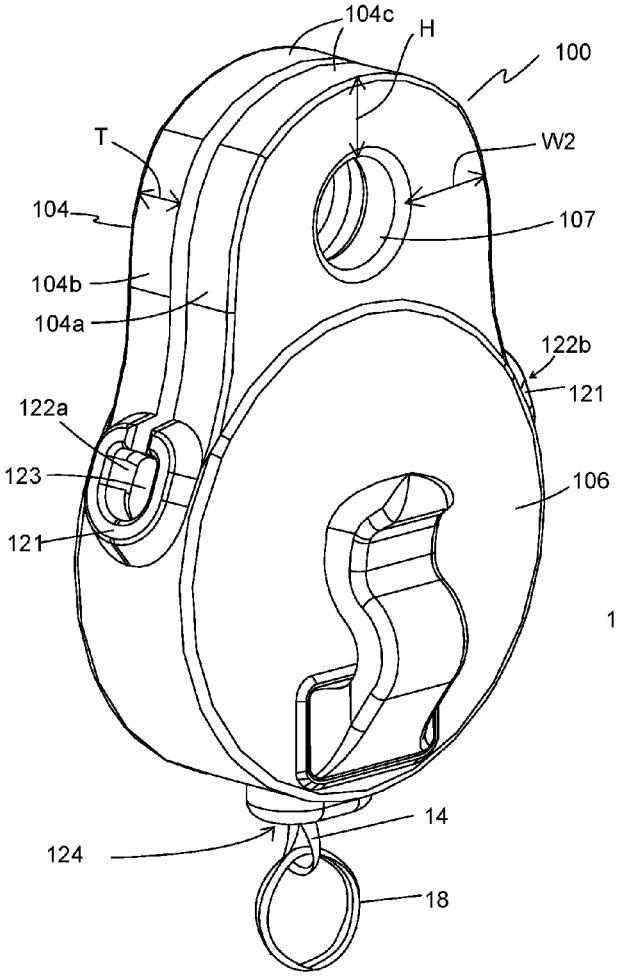
FIG. 12 is a front, perspective view of another embodiment of a retractor cover of the present invention containing a hand tool retractor showing a round handle opening, reinforced entrance ends in the perimeter wall and a split key ring connected to the retractor cable.

Referring now to FIG. 12, there is illustrated a front perspective view of another embodiment of retractor cover 100, where handle opening 107 has a round shape appropriate for use with a carabiner or other closed-loop connector 180 installed therethrough. In the embodiment shown in FIG. 12, a split key ring connector 18 is connected to retractor cable 14. Due to its larger size compared to retractor cable opening 124, a split key ring connector 18 or the like is useful to prevent retractor cable 14 from being retracted into retractor cover 100 where it may be inconvenient to retrieve by the user. Also, a split key ring connector 18 of any size can be selected so that connector 18 deforms when subjected to the force of a dropped tool to indicate retractor 10 has been subjected to one or more drops and therefore should be retired from service. Since failure in drop tests often occurs on the second, third, or other subsequent drop, it can be important to identify when retractor 10 has been subjected to a tool drop in order to avoid failure (breakage) on a subsequent drop.

For example, a split key ring may expand in size or become oblong in shape after one or more drops. In a drop test included in the data below, drops resulted in no failure of retractor 10 or to retractor cover 100. However, connector 18 (a split key ring) expanded in diameter by 75% compared to its original size. This visual change in appearance signals to the user that the retractor 10 inside retractor cover 100 has been subjected to drop forces and may be damaged or prone to failure.

In one embodiment, retractor cover 100 is made of silicone rubber with a Shore-A durometer of 42, where each of handles 104*a*, 104*b* defines handle opening 107 with a diameter of about 0.5 inch (12.7 mm), and has a handle thickness T of about 0.27 inch (6.85 mm), a width W2 of about 0.53 inch (13.4 mm) measured horizontally from handle opening 107, and a height H of about 0.36 inch (9.1 mm) measured vertically from handle opening 107 to a top 104*c* of handle portion 104. Body portion 106 has a wall thickness of about 0.08 inch (2.03 mm).

As shown in the embodiment of FIG. 12, first and second entrance ends 122*a*, 122*b* define an entrance end 123 opening of about 0.25 inch (6.35 mm) in diameter. Entrance ends 122*a*, 122*b* have been reinforced with a rim 121 that extends about 0.1 inch (2.6 mm) from perimeter wall 114 and has an average width of about 0.13 inch (3.3 mm). Rims 121 around entrance ends 122*a*, 122*b* resist tearing of body portion 160 when retractor cover 100 stretches due to the force of a dropped tool or the like. In static force tests, some embodiments of retractor cover 100 stretch to increase the overall length to approximately double its resting size or more as measured from a top 104*c* of handle portion 104 to retractor cable opening 124.

Figure 13:
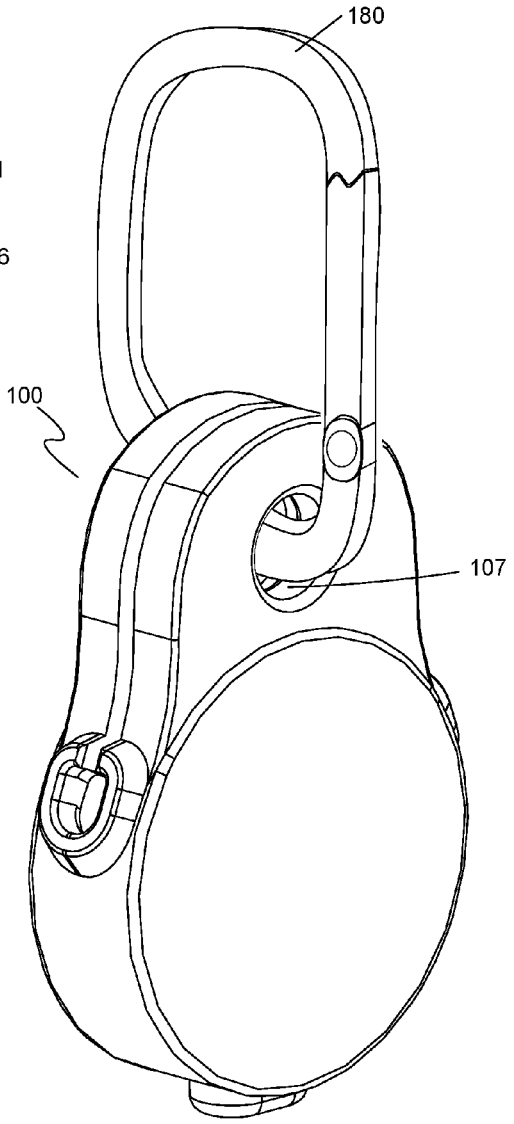
FIG. 13 is a front, perspective view of another embodiment of a retractor cover of the present invention showing a carabiner installed through the round handle opening.

FIG. 13 shows retractor cover 100 with a closed-loop connector 180 connected through round handle opening 107. Closed-loop connector 180 may be one of a carabiner, screw link, shackle, or similar hardware that is selectively closable by the user. Using a carabiner as closed-loop connector 180, retractor cover 100 is conveniently clipped to and removed from the user's clothing or equipment.

Figure 14:
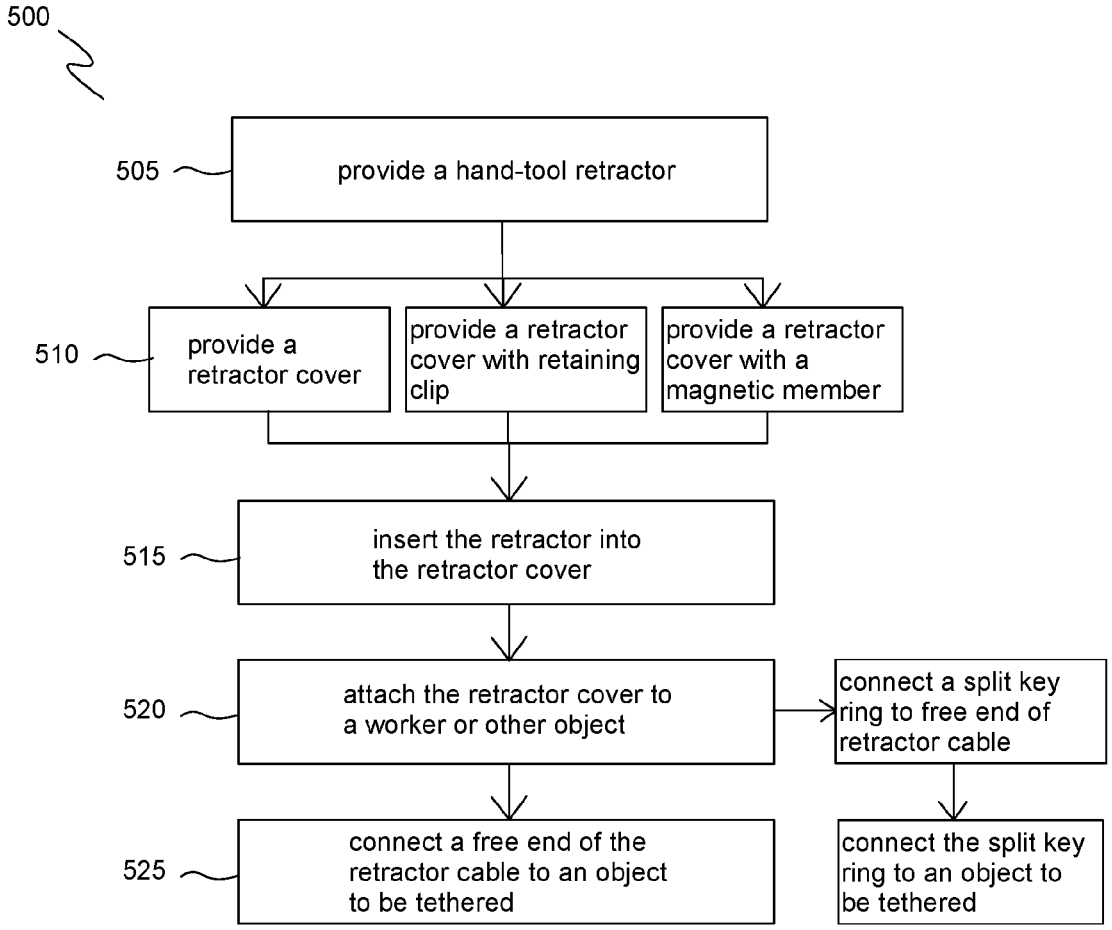
FIG. 14 is a flow chart illustrating steps in one embodiment of a method of tethering of the present invention.

Referring now to FIG. 14, a flow chart illustrates steps in one embodiment of a method 500 of increasing the weight rating of a hand tool retractor 10. In step 505, a retractor 10 is provided, where retractor 10 has a retractor body 12, and a retractor cable 14 releasably deployable from retractor body 12. As provided, retractor 10 has a pre-defined weight rating, which is often expressed as a load rating or dropped weight capacity without failure. In some embodiments, retractor 10 has a weight rating of 1-2 pounds.

In step 510, a retractor cover 100 is provided, where retractor cover 100 has body portion 106 sized and shaped to house retractor body 12 in retractor compartment 120 defined within retractor body 106 and allow removal and insertion of retractor 10 into retractor compartment 120. Retractor cover 100 is constructed to increase the dropped-tool holding strength of retractor 10 compared to its pre-defined weight rating or dropped-tool holding strength. Body portion 106 defines entrance 122 sized for installation of retractor body 106 into retractor compartment 120 as well as retractor cable opening 124 for deployment of retractor cable 14 therethrough. Retractor cover 100 also has a handle portion 104 attached to body portion 106 and defining handle opening 107. Handle portion 104 is made of a stretchable, resilient material. In some embodiments, retractor cover 100 is selected with body portion 106 and handle portion 104 made as a monolithic structure made of a rubber or the like with a durometer of from about 30 to about 70 on a Shore-A hardness scale. In some embodiments, retractor cover 100 is selected to include strap 150 defining a closed loop extending through handle opening 107. In some embodiments, strap is selected as a length of stretchable material, such as elastic webbing. The stretchable material further enables retractor cover 100 to absorb the forces of a dropped tool, thereby increasing the weight rating of retractor 10. In some embodiments, retractor cover 100 is selected to include a magnetic member 170 or tool-holding clip 130 positioned to engage and retain a hand tool.

In step 515, retractor 10 is installed in retractor cover 100 with retractor body 12 retained in retractor compartment 120 and retractor cable 14 extending through and operable through retractor cable opening 124. In embodiments where handle portion 104 includes first and second handle portions 104*a*, 104*b*, installing retractor 10 in retractor cover 100 includes spreading first and second handle portions 104*a*, 104*b* apart to open entrance 122 located between them along a top side 101 of body portion 106. Retractor 10 is then inserted through entrance 122 and positioned as needed so that retractor cable 14 extends through retractor cable opening 124. In other embodiments, retractor body 106 is stretched or temporarily deformed to enable retractor 10 to be installed in retractor compartment 120.

In step 520, retractor cover 100 with retractor 10 is secured to a worker, structure, or other object. In one embodiment, step 520 is performed by looping a length of strap 150 through handle opening 107 and also through another connector or around a tool belt, scaffolding, support, or other item. In other embodiments where retractor cover 100 includes strap 150 extending through handle opening, a connector is attached to strap 150 and also to the worker or other object to secure retractor cover 100 with retractor 10. For example, a carabiner, screw link, split ring, spring clip, or other connector is attached to strap 150 and enables the user to releasably attach retractor cover 100 with retractor 10 as desired to the worker or other object.

In step 525, retractor cable 14 is connected to a hand tool or other object to be tethered. In some embodiments, the hand tool or object is magnetic. Optionally, step 525 includes connecting a split key ring connector 18 between retractor cable 14 and the tool to be tethered. The construction of a split key ring results in deformation or an increase in size when subjected to drop forces. Therefore, a change in appearance of the split key ring can be used to indicate to the user that the retractor 10 has been subjected to forces of one or more tool drops (usually several drops) and that retractor 10 should be retired from service due to unseen damage or weakening of retractor 10 components.

Depending on the retractor cover provided, the hand tool or other object is positioned to engage a disk-shaped magnetic member 170 or a tool-holding clip 130. For example, a steel tool is placed directly or indirectly against magnetic member 170 to hold the tool when it is not in use. This storage option avoids retractor cable 14 deploying due to the weight of the tool when the tool hangs freely from retractor 10. Similarly, the tool may be installed between tool-holding clip 130 and body portion 106 to store the tool.

In use, retractor cover 100 increases the weight rating of retractor 10 by absorbing the force of a dropped tool. Due to the flexible and resilient material used for handle portion 104 (and body portion 106 in some embodiments), handle portion 104 stretches when a tool is dropped and reaches the end of the length of retractor cable 14. When equipped with a stretchable strap 50, strap 50 further absorbs the force of a dropped tool. By absorbing some of the force of a dropped tool, retractor cover 100 effectively increases the weight rating of retractor 10.

Drop-Test Data

Drop tests were performed using retractors 10, where a predefined amount of weight was secured to the free end of the extended retractor cable 14 and then dropped from above the retractor 10 a total drop distance of 96 inches (2.43 m). Placing the weight above the retractor 10 was performed to more closely reflect actual use since the retractor 10 is typically attached to a tool belt around a worker's waist while the tethered tool in use is typically above the waist. In such a scenario, the tethered tool would drop from above the retractor to below the retractor. Drop tests were useful to determine the weight at which retractor 10 failed. Failure of the retractor 10 is typically exhibited by damage resulting in inoperability of the retractor 10.

Several retractors 10 were evaluated at room temperature with and without being installed in retractor cover 100. When installed in retractor cover 100, retractor 10 is snugly received in compartment 120. Retractor covers 100 as in FIG. 1 with two different durometer values were tested. One retractor cover 100 was made of silicone rubber with a Shore-A durometer of 50 and another retractor cover 100 was made of silicone rubber with a Shore-A durometer of 70. Retractor cover 100 in these tests included strap 50 made of woven cotton elastic strap 50 with a width of about one inch and installed as shown in FIG. 11. A carabiner connected strap 50 to a fixed structure. For tests without retractor cover 100, retractor body 12 was supported and secured to a fixed structure.

TABLE 1

| drop-test data | | |
|---|---|---|
| Item tested | Max. weight without failure of retractor | Change in max weight vs. retractor alone |
| Retractor alone | 1.75 lbs. | Not applicable |

TABLE 1-continued

| drop-test data | | |
|---|---|---|
| Item tested | Max. weight without failure of retractor | Change in max weight vs. retractor alone |
| With retractor cover - 70 durometer | 3.5 lbs. | Increased 100% |
| With retractor cover - 50 durometer | 4.5 lbs. | Increased 157% |

When tested without retractor cover 100, retractor 10 could withstand drops without failure with a maximum weight of about 1.75 pounds (0.8 Kg.) Using retractor cover 100 with a durometer of 70, the maximum weight without failure of retractor 10 increased to 3.5 pounds (1.6 Kg), which is an increase of 100%. Using retractor cover 100 with a durometer of 50, the maximum weight increased to 4.5 pounds (2.05 Kg.), which is an increase of 157%.

Additional drop tests were performed for retractor covers 100 having other durometers. Results of these drop tests are shown in Table 2 below. Each test was performed at room temperature using a retractor 10 with or without retractor cover 100. The retractors 10 in these experiments were the same retractors as used in the drop tests of Table 1. Retractor covers 100 with Shore-A durometers of 30, 40, 45, and 50 were tested with a weight of 4.5 lbs. (2.05 Kg.) Weights were dropped from a point above the retractor for a total drop distance of 96 inches (2.43 m).

Retractors 10 were also tested without a retractor cover 100 using weights of 1.75 lb. (0.8 Kg.) and 2.0 lbs. (0.9 Kg.). Results of these tests are also shown in Table 2. Retractors 10 failed with a 2.0 lb. (0.9 Kg.) weight, but passed with a 1.75 lb. (0.8 Kg.) weight. Thus, for the tested retractors, the maximum weight without retractor failure is about 1.75 lbs. (0.8 Kg) when the weight is dropped a total distance of 96 inches (2.43 m).

TABLE 2

| Drop Test Data | | |
|---|---|---|
| Durometer of Retractor Cover 100 | Tested weight | Result |
| 30 | 4.5 lbs. | Passed |
| 40 | 4.5 lbs. | Passed |
| 45 | 4.5 lbs. | Passed |
| 50 | 4.5 lbs. | Passed |
| No cover | 1.75 lbs. | Passed |
| No cover | 2.0 lbs. | Failed |

As shown in Table 2, retractor covers 100 with a durometer from 30 to 50 all passed with a weight of 4.5 lbs. (2.05 Kg.), an increase of at least 155% in the retractor weight rating compared to the retractor without retractor cover 100. For failures that did occur after multiple drops when the retractor was disposed in a retractor cover 100, the type of failure observed was different for retractor covers 100 of different durometers. For example, for retractor cover 100 with a durometer of 30, failure occurred when the retractor 10 pulled through the retractor cable opening 124. For retractor cover 100 with a durometer of 50, failure occurred by the retractor cable breaking.

Further drop tests were performed using retractor cover 100 with a durometer of 40 and having a strap 50 made installed through handle opening 107 as shown in FIG. 11. In one test, strap 50 is made of 1-inch (2.5 cm) elastic webbing. In another test, strap 50 is made of 1-inch (2.5 cm) nylon (non-elastic) webbing. Using strap 50 made of nylon webbing and a weight of 4.5 lb. (2.05 Kg), failure occurred on the second drop when the retractor 10 pulled through the retractor cable opening 124. Using strap 50 made of elastic webbing, and a weight of 6.0 lb. (2.7 Kg), failure also occurred on the second drop with the retractor 10 pulling through the retractor cable opening 124. Thus, retractor cover 100 with a 1-inch (2.5 cm) nylon strap 50 has a weight capacity of 4.5 lbs. (2.05 Kg) and retractor cover 100 with a 1-inch (2.5 cm) elastic strap 50 has a weight capacity of 6.0 lbs. (2.7 kg.) when the weight is dropped a total distance of 96 inches (2.43 m). From these tests, it is concluded that strap 50 made of elastic webbing increases by 1.5 lbs. (0.7 Kg) the maximum weight of retractor 10 compared to using strap 50 made of nylon webbing.

Still further drop tests were performed using a 2.2 mm×30 mm split key ring connected between the retractor cable 14 and the weight. The split key ring has a load rating no greater than the retractor 10 installed in the retractor cover 100. The retractors 10 were disposed in a retractor cover 100 with a durometer from 30 to 50. The results of these tests are shown in Table 3 below. These tests evaluated changes to the key ring after three drops, where deformation or failure of the split key ring indicates the retractor 10 has been subjected to forces of a dropped tool.

TABLE 3

| Drop Test Data with Key Ring | | |
|---|---|---|
| Durometer of Retractor Cover 100 | Tested weight | Result of Key Ring |
| 30 | 4.5 lbs. | No change |
| 40 | 4.5 lbs. | Diameter increased 50% after 3 drops |
| 45 | 4.5 lbs. | Diameter increased 75% after 3 drops |
| 50 | 4.5 lbs. | Key ring broke on 3rd drop |

Still further, tensile force tests were performed using a retractor cover 100 with a Shore-A durometer of 40 and the same model retractor as used in other tests discussed above. The retractor 10 pulled through cable opening 124 of retractor cover 100 at 45 lbs. (20 Kg) where cable opening 124 has a first diameter of 0.4 inch (10 mm) and a second diameter of 0.2 inch (5 mm).

Embodiments of retractor cover 100 of the present invention have the advantage of significantly increasing the dropped-tool holding strength of a retractor 10 when the retractor 10 is disposed in a retractor cover 100 where a hand tool is attached to the free end of the retractor cable extending through the retractor cable opening 124. As shown experimentally, the maximum weight is increased 100% or more for a retractor 10 that by itself breaks with a 2.0 pound weight. When the hand tool is dropped, the stretchable and resilient material of retractor cover 10 deforms to absorb forces of the dropped tool and reduce the force of the dropped tool sustained by the retractor 10. Connecting retractor cover 100 to the worker or to a structure using an elastic strap 50 looped through the handle portion 104 has been shown experimentally to further increase the maximum weight of the hand tool that may be used with retractor 10 without causing damage to the retractor 10 when the tool is dropped.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A hand-tool retractor cover comprising:

a body portion having a first-side wall, a second-side wall spaced apart from and substantially parallel to the first-side wall, and a perimeter wall extending transversely between and connecting the first-side wall to the second-side wall, wherein the body portion has a wall thickness and defines a retractor compartment substantially enclosed by the first-side wall, the second-side wall, and the perimeter wall, and wherein the body portion defines an entrance into the retractor compartment and a retractor cable opening; and a handle portion with a handle thickness and attached to and extending from the body portion, the handle portion defining a handle opening;

wherein at least one of the body portion and the handle portion is made of a stretchable and resilient material adapted to increase a weight rating of a hand tool retractor when a hand tool retractor is placed within the hand tool retractor cover; and wherein the handle thickness is greater than the wall thickness, thereby rendering the body portion more stretchable than the handle portion.

2. The hand-tool retractor cover of claim 1, wherein the entrance comprises a slot along a top side of the perimeter wall and wherein the handle portion comprises:

a first handle portion extending from a top side of the body portion and adjacent the slot, the first handle portion defining a first handle opening; and a second handle portion extending from the top side of the body portion and adjacent the slot, the second handle portion defining a second handle opening wherein the first handle opening and the second handle opening are aligned with each other and comprise the handle opening;

wherein the first handle portion and the second handle portion are separable to permit access to the retractor compartment via the entrance.

3. The hand-tool retractor cover of claim 1, wherein the stretchable and resilient material is a silicone rubber with a durometer from about 30 to about 70 on a Shore-A hardness scale.

4. The hand-tool retractor cover of claim 3, wherein the body portion is made of the stretchable and resilient material.

5. The hand-tool retractor cover of claim 4, wherein the body portion and the handle portion are a monolithic structure.

6. The hand-tool retractor cover of claim 1 further comprising a tool-holding clip attached to the body portion.

7. The hand-tool retractor cover of claim 6 further comprising a magnetic member retained by the body portion.

8. The hand-tool retractor cover of claim 1 further comprising closed-loop connector extending through the handle opening, the closed-loop connector selected from the group consisting of a strap made of a stretchable material and defining a closed loop, a carabiner, a screw link, and a shackle.

9. The hand-tool retractor cover of claim 1 further comprising a retractor having a retractor body and a retractor cable, wherein the retractor body is sized to snugly fit in the retractor compartment with the retractor cable extending through the retractor cable opening.

10. A hand-tool retractor cover comprising:

a body portion having a first-side wall, a second-side wall spaced apart from and substantially parallel to the first-side wall, and a perimeter wall extending transversely between and connecting the first-side wall to the second-side wall, wherein the body portion has a wall thickness and defines a retractor compartment between the first-side wall, the second-side wall, and the perimeter wall, and wherein the body portion defines an entrance into the retractor compartment and a retractor cable opening opposite the entrance; and a handle portion comprising:

a first handle portion with a first handle thickness, extending from the body portion adjacent the first-side wall, and defining a first handle opening therethrough;

a second handle portion with a second handle thickness, extending from the body portion adjacent the second-side wall, and defining a second handle opening therethrough;

wherein the first handle portion and the second handle portion extend from the body portion from opposite sides of the entrance in substantially parallel relation with the first handle opening aligned with the second handle opening;

wherein the retractor cover is made of an elastomer adapted to increase a weight rating of a hand tool retractor when a hand tool retractor is placed within the hand tool retractor cover and wherein the first handle thickness and the second handle thickness are each greater than the wall thickness, thereby rendering the body portion more stretchable than the handle portion.

11. The hand-tool retractor cover of claim 10, wherein the elastomer is a silicone rubber with a durometer from about 30 to about 70 on a Shore-A hardness scale.

12. The hand-tool retractor cover of claim 10 further comprising a tool-holding clip attached to the body portion.

13. The hand-tool retractor cover of claim 10 further comprising a permanent magnet retained by the body portion.

14. The hand-tool retractor cover of claim 13, wherein the permanent magnet has a size sufficient to retain a ferrous hand tool with a hand tool weight of at least eight ounces.

15. The hand-tool retractor cover of claim 10, wherein the wall thickness is at least 3 times as great as the first handle thickness and at least 3 times as great as the second handle thickness.

16. The hand-tool retractor cover of claim 15, wherein the wall thickness is about 0.08 inch.

17. In combination a retractor and a hand-tool retractor cover, the combination comprising:

a hand-tool retractor cover comprising:

a body portion having a first-side wall, a second-side wall spaced apart from and substantially parallel to the first-side wall, and a perimeter wall extending transversely between and connecting the first-side wall to the second-side wall, wherein the body portion defines a retractor compartment between the first-side wall, the second-side wall, and the perimeter wall, and wherein the body portion defines an entrance into the retractor compartment and a retractor cable opening; and a handle portion attached to and extending from the body portion and defining a handle opening;

wherein, the retractor cover is made at least in part of a stretchable and resilient material; and a hand-tool retractor comprising:

a retractor body; and a retractor cable selectively deployable from the retractor body;

wherein the stretchable and resilient material is adapted to increase a weight rating of the hand tool retractor when the hand tool retractor is placed within the hand tool retractor cover.

18. The combination of claim 17, wherein the hand-tool retractor cover increases the weight rating by at least 40% a maximum weight without failure of the hand-tool retractor when the hand-tool retractor is disposed in the retractor compartment.

19. The combination of claim 17, wherein the stretchable and resilient material is a silicone rubber with a durometer from about 30 to about 70 on a Shore-A hardness scale.

20. The combination of claim 17 further comprising a closed-loop connector extending through the handle opening, the closed-loop connector selected from the group consisting of a strap made of a stretchable material and defining a closed loop, a carabiner, a screw link, and a shackle.

21. The combination of claim 17 further comprising a tool retaining structure on the body portion, the tool retaining structure selected from the group consisting of a tool-holding clip attached to the first-side wall, a magnetic member attached to the first-side wall, and a magnetic member disposed in the retractor compartment, and a tool-holding clip partially disposed in the retractor compartment with a clip body portion extending along an outside surface of the first-side wall.

22. The combination of claim 17 further comprising a split key ring connected to a free end of the retractor cable, wherein the split key ring has a weight rating no greater than the weight rating of the retractor when installed in the retractor cover and wherein the split key ring is adapted for connection to a lanyard.

* * * * *